United States Patent [19]

Holm

[11] 4,098,189

[45] Jul. 4, 1978

[54] METHOD AND APPARATUS FOR PREPARING AN EXPLOSIVE CHARGE

[76] Inventor: Harry Holm, Odens vag 15, S-150 22 Nykvarn, Sweden

[21] Appl. No.: 727,623

[22] Filed: Sep. 28, 1976

[51] Int. Cl.[2] ..... F42B 1/02

[52] U.S. Cl. ..... 102/24 R; 86/20 R; 264/3 R

[58] Field of Search ..... 86/20 R, 20 A, 20 B, 86/20 C, 20 D, 1 R, 23 R, 24 R; 102/24 R; 141/27; 229/48 T; 215/32; 264/3 R

[56] References Cited

U.S. PATENT DOCUMENTS

| | | | |
|---|---|---|---|
| 999,396 | 8/1911 | Peters et al. | 86/20 A |
| 1,000,663 | 8/1911 | Bichel | 86/20 D |
| 1,074,263 | 9/1913 | Issler | 86/20 D |
| 1,075,903 | 10/1913 | Dewey | 86/20 A |
| 1,298,167 | 3/1919 | Bowman | 86/20 A |
| 2,877,504 | 3/1959 | Fox | 86/1 R X |
| 3,108,708 | 10/1963 | Betner | 229/48 T |
| 3,246,602 | 4/1966 | Meredith et al. | 102/24 R |
| 3,307,445 | 3/1967 | Stadler et al. | 86/20 R |
| 3,713,384 | 1/1973 | Turnbull | 102/24 R |
| 3,793,954 | 2/1974 | Johnston | 102/24 R |
| 3,844,318 | 10/1974 | Raia et al. | 141/27 |

*Primary Examiner*—Harold Tudor

[57] ABSTRACT

A cartridge is filled with mouldable explosive by a piston and cylinder device. A detonator is inserted into a tube within the cartridge so that the detonator is completely surrounded with explosive. The cartridge is made of transparent material and is graduated so that the quantity of explosive within the cartridge can be observed.

7 Claims, 3 Drawing Figures

METHOD AND APPARATUS FOR PREPARING AN EXPLOSIVE CHARGE

BACKGROUND OF THE INVENTION

The present invention relates to a method of preparing an explosive charge from an explosive and a detonator, such as an explosive charge intended for insertion into a drill hole. The invention also relates to an apparatus for use in performing the method of the invention.

PRIOR ART

Explosive charges formed from a mouldable explosive material and a detonator have previously been prepared by cutting off a portion of explosive material from an oblong block of the explosive material and then applying this portion of explosive material to a detonator, the explosive material being moulded and shaped manually substantially to surround the detonator.

This prior art method and the subsequent use of explosive charges made by this prior art method are associated with serious drawbacks or disadvantages.

An explosive charge of a mouldable explosive material applied to a detonator in the above described conventional way can, of course, be lowered into a drill hole to the desired position, by means of a detonating fuse secured to the detonator. However, it has been found that the slightest pull on the detonating fuse may result in the explosive becoming separated from the detonator. If this happens the explosive will not be detonated when the detonator is activated. Also it has been found that frequently not all the explosive material of a charge made by the above described method is exploded when the detonator is activated. Any explosive which is not detonated and which remains in a drill hole and can cause extremely serious injuries when the drill operator continues drilling without realizing that there is any explosive left and unintentionally sets off an explosion.

If the detonator is not completely covered by explosive, a frequent occurrence with the above described methods, there will be an angle between the drill hole and the explosive charge when the charge is inserted into the hole and this may easily result in the detonator becoming lodged in a crack in the rock. In cases where this has happened attempts to dislodge the detonator with a so-called charge pin have often been found to damage the detonator or cause insulation faults in the detonating fuse of the detonator.

Another disadvantage of the above described method is that the operator comes into direct skin contact with the explosive while shaping it around the detonator. The operator is therefore subjected to noxious gases emitted from the explosive which may result in altered blood pressure.

When small explosive charges are being used in shallow holes it is important for the diameter of the hole to be as small as possible so that the pressure of gas acting against the rock as a result of the explosion will give the desired result. With a hole diameter of about 20 mm the compression space will be reduced, and the area of rock exposed to the high pressure gas during the explosion will be low. With a hole diameter of about 30 mm for a drill hole 30 to 50 cm deep, when the explosion occurs plugging sand will be thrown out, resulting in a "barrel shot". The charge quantity can be increased to avoid this phenomenon, but such a measure often entails the risk of generating flying pieces of rock. Thus, with the present charging technique it has been impossible to achieve the ideal of using the least possible quantity of explosive for a charge while at the same time obtaining the greatest possible effect.

BRIEF SUMMARY OF THE INVENTION

According to one aspect of this invention there is provided a method of preparing an explosive charge comprising a mouldable explosive material, a detonator, and a cartridge, said cartridge comprising a casing defining a cavity open at one end thereof and a hollow tube for accommodating a detonator substantially centrally disposed within said casing and open at an end thereof remote from the said one end of the cavity, said method comprising the steps of:

connecting the cartridge to a piston and cylinder device which contains mouldable explosive material;

operating the piston to urge said explosive material into said cavity to at least partially fill said cavity with explosive, with said explosive surrounding said hollow tube;

and inserting a detonator into said hollow tube through the open end thereof.

According to another aspect of this invention there is provided an apparatus for preparing an explosive charge comprising a mouldable explosive material, a detonator, and a cartridge, said cartridge comprising a casing defining a cavity open at one end thereof and a hollow tube, for accommodating a detonator substantially centrally disposed within said casing and open at an end thereof remote from the said one end of the cavity, said apparatus comprising said cartridge and a piston and cylinder device, means for releasably connecting the cartridge to the piston and cylinder device with the cylinder thereof communicating with said cavity within the cartridge.

The cylinder of the apparatus preferably has an internal diameter slightly larger than the diameter of the sticks of explosive material to be used. Pieces of such sticks can be cut off and located in the cylinder, but this may even be of such a length that a complete stick can be inserted therein. A suitable mouldable gelatinized explosive is sold under the trade name Dynamex. However, the invention is not limited to the use of this particular explosive but may be used for any type of explosive which can be urged in the cartridges by the piston and cylinder device.

It has been found that the present invention makes it possible to use a very small quantity of explosive while achieving a relatively great explosive effect for the gas pressure against the rock. The explosive charges made by a method in accordance with the invention can with advantage be dimensioned for use in drill holes about 20 mm in diameter. Since the explosive need not be handled manually in order to surround the detonator the invention involves less risk of affecting the blood pressure of personnel performing the invention. As a result of the central position of the detonator in the tube of the cartridge, surrounded by the outer casing, the entire quantity of explosive will always be detonated. The nose of the cartridge is preferably conical enabling the explosive charge to be lowered into a drill hole safely without any risk of becoming lodged in a crack in the rock. Thus the cartridge can be placed securely at the bottom of the drill hole. Furthermore, by enclosing the explosive in a cartridge in accordance with the present invention, the advantage is also gained that such a cartridge can even be placed, if desired, in a drill hole containing water, which has been substantially impossible with charges prepared in conventional manner.

One of the more important advantages with the explosive charges produced in accordance with the invention is that their use increases safety in blasting work. The invention also enables accurate measurement of the quantity of explosive judged necessary for a certain purpose. When making such decisions it is often necessary to take into consideration buildings or objects in the vicinity which complicate satisfactory covering of the explosion spot or make it impossible. The invention enables smaller charges to be used as well as narrower drill holes (20 mm) than previously, thus giving more reliable results and the depth of the hole can be reduced without plugging sand being shot out. Less dust is also caused when dry-drilling the smaller holes so that half the weights applied on the drill can be removed while still retaining the same drilling rate. This means a reduction in the weight of the drill by about 7 kg which increases the efficiency and reduces risks of accidents.

DESCRIPTION OF PREFERRED EMBODIMENTS OF THE INVENTION

Figure 1:
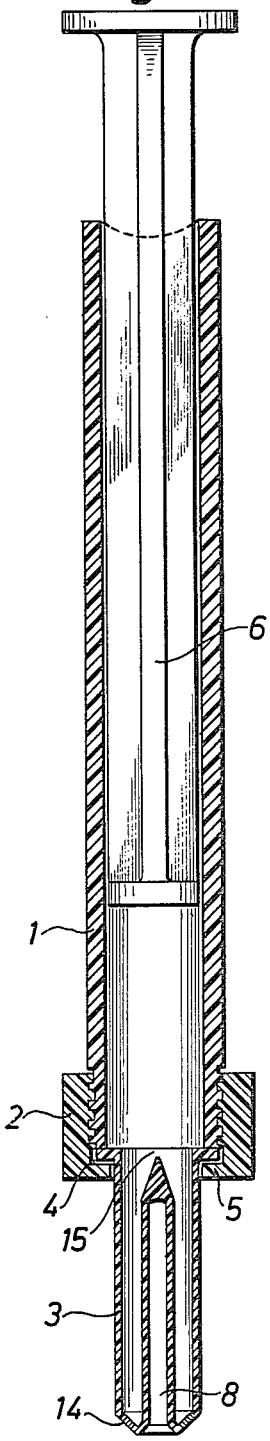
FIG. 1 shows one embodiment of an apparatus according to the invention comprising a cylinder fitted with a piston, a cartridge being connected to the apparatus.
Figure 2:
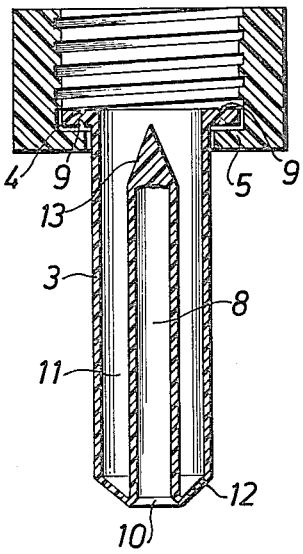
FIG. 2 shows a cartridge as illustrated in FIG. 1, with connecting sleeve.

FIG. 1 of the drawings shows a cylindrical cartridge 3 which is connected for filling with explosive to a cylinder 1 provided with a piston 6. The lowermost end of the cylinder 1 is provided with an externally threaded section to receive an internally threaded connecting sleeve 2, which may be in the form of a nut, to secure the cylindrical cartridge 3 to the lowermost end of the cylinder 1. The connecting sleeve 2 is provided with an inwardly directed, annular flange 5 which encloses and presses against a corresponding outwardly directed flange 4 provided on the cartridge 3. The flange 4 of the cartridge 3 is provided with two opposing grooves 9 enabling the flange 4 to be easily separated from the cartridge 3 after the cartridge has been filled with explosive. The cartridge 3 is also provided with a central tube 8 for receipt of a detonator 7 through an opening 10 in the end of the cartridge 3 facing away from the cylinder 1. The tube 8 is preferably the length of the casing in order to accomodate varying detonators. The end of the cartridge 3 provided with the opening 10 is preferably conical in order to facilitate insertion of the cartridge into and passage of the cartridge down a drill hole. The cartridge 3 is also provided with one or more holes or openings 14 for evacutation of air from the space 11 during the filling process. One or more such holes can thus be arranged in the conical end wall 12 or in the central tube close to the opening 10. The space 11 in the cartridge 3, which surrounds the central tube 8, is in direct communication with the inside of the cylinder 1 through an opening 15 in the cartridge. The closed end 13 of the central tube, facing the cylinder 1, is preferably pointed or rounded in order to facilitate insertion of the explosive into the space and distribution of the explosive around the central tube.

Figure 3:
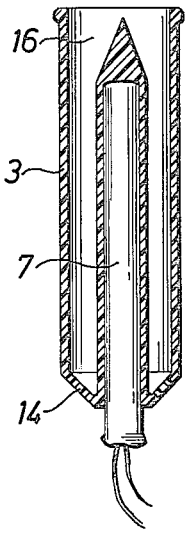
FIG. 3 shows a finished explosive charge with an inserted detonator.

In order to prepare an explosive charge a cartridge 3 is first secured to the cylinder 1 by means of the connecting sleeve 2. If not already done, the cylinder 1 is filled with a mouldable explosive which is then pressed by the piston 6 into the space 11 in the cartridge. The quantity of explosive pressed in in this way may vary from case to case and is dependent upon the explosive action desired. The cartridge may preferably be made of a translucent or transparent plastics material enabling visual control of the filling level, in which case the cartridge is preferably provided with visible markings or graduations in charge quantities of, for instance, 10 and 20 gram. Corresponding graduations 16 may also be marked on the cylinder if desired, which may also be made of a suitable plastics material. The piston 6 may also be graduated to indicate the quantity of explosive pressed into the cartridge. When the cartridge 3 has been filled with the desired quantity of explosive 16, it is removed from the cylinder 1 by unscrewing the connecting sleeve 2, the cartridge then being released from the connecting sleeve by axial displacement. The flange 4 on the cartridge is removed by gentle pressure from the thumb, after which a detonator is inserted into the central hole of the cartridge as shown in FIG. 3, in order to obtain a finished explosive charge ready for immediate placing in a drill hole possibly with the help of a so-called charging pin, in which case the conical end 14 is inserted first into the drill hole. Alternatively the completed cartridge may be stored for later use.

In one embodiment of the invention the cartridge and its central tube 8 are made in one piece from a suitable plastics material. In alternative embodiments of the invention the cartridge can be connected to the cylinder in many ways other than that shown. For instance, the cylinder may be provided with a groove, for example, a U-shaped groove, into which the flange 4 can be inserted from the side, in which case the connecting sleeve can be omitted. The central tube normally extends the full length of the cartridge. The mouldable explosive may be produced in the form of cylindrical bodies with varying, predetermined weight for instance, which bodies may be provided with cylindrical holes or notches so that a body with the desired weight can be inserted in a cartridge of the type described with the help of the piston cylinder.

I claim:

1. A method of preparing an explosive charge comprising a moldable explosive material, a detonator, and a cartridge, comprising the steps of forming a cartridge comprising a casing defining a cavity open at one end thereof and a hollow tube of substantially the same length as the casing for accomodating a detonator substantially centrally disposed within said casing and open at an end thereof remote from the said one end of the cavity, a wall having at least one hole therein connecting the periphery of the open end of said tube to said casing, the end of said tube adjacent the open end of said casing being tapered to facilitate entry of said moldable explosive material and said casing being formed with a radially outwardly extending flange at said open end to facilitate holding of said cartridge on introduction of said moldable explosive material, connecting the cartridge to a piston and cylinder device which contains moldable explosive material; said cylinder having means for securing the radial flange at the end of the cylinder, operating the piston to urge said explosive material into said cavity to at least partially fill said cavity with explosive, with said explosive surrounding said hollow tube; and inserting a detonator into said hollow tube through the open end thereof.

2. An explosive cartridge comprising a cylindrical casing open at one end and a coaxially hollow tube extending into said casing from the other end, a wall integrally connecting the casing and the tube at the end opposite the open end, said tube being of substantially the same length as said casing defining a space for accomodating a basting cap, said tube and casing defining therebetween a cavity for receipt of a moldable explosive material, the end of said tube adjacent the open end of said casing being tapered to facilitate entry of said moldable explosive material and the connecting wall having at least one hole for the exhaust of air on introduction of the explosive material.

3. The blasting cap according to claim 2, wherein the flange of the cartridge is removable from said casing.

4. The blasting cap according to claim 3 including a radially outward flange at the open end of said casing, said flange being provided with a shallow annular groove adjacent the surface of said casing to permit removal thereof.

5. The blasting cap according to claim 2, wherein the casing and the tube are formed in one piece from a translucent plastic material to indicate the quantity of explosive within the cartridge.

6. The blasting cap according to claim 5 including graduation indicia on the surface of said cap to indicate the quantity of explosive therein.

7. The blasting cap according to claim 2, wherein said connecting wall is tapered inwardly.

* * * * *